US005540128A

United States Patent [19]

Creaden

[11] Patent Number: 5,540,128

[45] Date of Patent: Jul. 30, 1996

[54] SELECTIVELY RETRACTABLE SLUTTER BLADE MECHANISM WITH REMOTE ACTIVATION/DEACTIVATION FUNCTION

[75] Inventor: David E. Creaden, Lawrence, Kans.

[73] Assignee: Lawrence Paper Company, Lawrence, Kans.

[ * ] Notice: The term of this patent shall not extend beyond the expiration date of Pat. No. 5,297,462.

[21] Appl. No.: 379,942

[22] Filed: Jan. 27, 1995

[51] Int. Cl.[6] ..... B26D 1/12

[52] U.S. Cl. ..... 83/305; 83/332; 83/345; 83/508.1; 83/563; 83/678; 493/370; 493/471; 493/475

[58] Field of Search ..... 83/305, 332, 345, 83/508.1, 563, 678, 482, 528, 677; 493/365, 367, 370, 471, 475

[56] References Cited

U.S. PATENT DOCUMENTS

| | | | |
|---|---|---|---|
| 910,556 | 1/1909 | Mann . | |
| 1,127,945 | 2/1915 | Tognini . | |
| 1,802,554 | 4/1931 | Hahn | 83/345 |
| 3,006,276 | 10/1961 | Deslauriers et al. . | |
| 3,008,366 | 11/1961 | Taylor, Jr. | 83/346 |
| 3,067,643 | 12/1962 | Ward . | |
| 3,466,982 | 9/1969 | Sullivan . | |
| 3,804,402 | 4/1974 | Hottendorf . | |
| 3,952,637 | 4/1976 | Lambert . | |
| 4,003,300 | 1/1977 | Grobman . | |
| 4,090,433 | 5/1978 | Jardine . | |
| 4,666,142 | 5/1987 | Tsukasaki . | |
| 4,712,461 | 12/1987 | Rasmussen | 83/334 |
| 4,805,502 | 2/1989 | Ishigure | 83/677 |
| 4,962,684 | 10/1990 | Mowry | 83/345 |
| 5,181,899 | 1/1993 | Hill et al. . | |
| 5,246,222 | 9/1993 | Hill et al. . | |
| 5,316,538 | 5/1994 | Hill et al. . | |
| 5,338,019 | 8/1994 | Hill et al. . | |

FOREIGN PATENT DOCUMENTS

| | | | |
|---|---|---|---|
| 0476626 | 3/1992 | European Pat. Off. . | |
| 2403600 | 8/1974 | Germany | 271/144 |
| 59-133143 | 7/1984 | Japan . | |
| 287944 | 4/1953 | Switzerland . | |
| 2145065 | 8/1983 | United Kingdom . | |

*Primary Examiner*—Rinaldi I. Rada
*Assistant Examiner*—Allan M. Schrock
*Attorney, Agent, or Firm*—Hovey, Williams, Timmons & Collins

[57] ABSTRACT

Improved slotter wheel apparatus (20) for use in the formation of box blanks is provided which includes a rotatable wheel (22) supporting a shiftable blade holder (24) and a slotting blade (26), with cooperating cam track (174) and follower (86) structure for selective shifting of blade (26) between an extended slotting position and a retracted blank-clearing position. An activation/deactivation assembly (30) allows the operator to separate cam track (174) from follower (88), thereby permitting use of apparatus (20) as a conventional, high speed, fixed blade slotter. A shock absorbing assembly (27) including a bridge piece (138) operably coupled with blade holder (24) and resilient pads (152, 154) serve to absorb potentially destructive mechanical loads experienced during outward shifting of the blade holder (24) and blade (26).

25 Claims, 5 Drawing Sheets

SELECTIVELY RETRACTABLE SLUTTER BLADE MECHANISM WITH REMOTE ACTIVATION/DEACTIVATION FUNCTION

BACKGROUND OF THE INVENTION

1. Field of the Invention

The present invention is broadly concerned with improved slotter wheel apparatus of the type used in box-making operations for the purpose of creating strategically located and sized slots in box blanks which in turn define the flap sections of a completed box. More particularly, the invention relates to improved slotter wheel apparatus of the type described in U.S. Pat. No. 5,297,462 which include dynamically retractable slotter blades permitting use of a given slotter wheel in the production of a wide variety of box blank sizes, i.e., the apparatus permits retraction of slotter blades during rotation of the slotter wheel so that blanks of any practical length can be formed using standard sized slotting machines.

The present invention provides such retractable slotter wheel apparatus which is improved by provision of a remote activation/deactivation assembly permitting the slotter wheel to alternately operate in a conventional, high rotational speed mode with the slotter blade(s) extended, or alternately in a mode where the slotter blade can be selectively extended and retracted for specialized blank-forming operations. In addition, the improved slotter wheel assembly hereof provides a shock absorbing assembly designed for absorbing mechanical shocks incident to shifting of the wheel blade(s) between the retracted and extended positions thereof.

2. Description of the Prior Art

Conventional box making operations involve initially cutting a box blank typically formed of corrugated board, followed by subjecting the blank to creasing and slotting steps in order to define the sides and end flaps of the blank. Generally speaking, the creasing and slotting operations are performed using adjacent, serially aligned creasing and slotting wheels respectively mounted upon powered shafts. As the blank is fed through the creasing/slotting device, the rotating creasing and slotting wheels act on the blank to create a series of spaced slot pairs of desired length separated by continuous creases. In this manner, the side panels of the final box are formed, along with the end closure flaps thereof. In order to efficiently produce blanks of varying dimensions, the slotting and creasing wheels may be shifted laterally along the lengths of their supporting shafts; moreover, cutting blades of varying lengths may be bolted to the slotting wheels at any one of a number of positions thereon, so that the size and location of the flap-defining slots may be altered.

While creasing/slotting devices of the type described are well known, they suffer from a serious drawback in that there are definite limitations as to the size of blanks which they may accommodate and process. That is, the maximum blank length which may be handled using a conventional slotter wheel is determined by the effective diameter of the wheel and knife blade. If it is desired to produce a larger blank, the only recourse is to employ a larger, more expensive slotting device. As will be appreciated, this problem stems from the fact that the slotter blade carried by conventional slotter wheel is fixed during rotation thereof and accordingly creates a corresponding slot during every wheel revolution.

U.S. Pat. No. 4,805,502 describes a slotter wheel device wherein the wheel-supporting shaft is equipped with an eccentric permitting selective movement of the supported slotting blades to a non-cutting position. However, the apparatus described in the '502 patent is incapable of moving a slotting blade between an extended slotting position and a retracted, blank-clearing position during rotation of the slotting wheel. In short, it is necessary to stop the operation of the wheel, manipulate the eccentric to alter the blade position, and then resume operations. Accordingly, the device described in this patent cannot accommodate oversized blanks and suffers from the same deficiencies as conventional slotters.

SUMMARY OF THE INVENTION

The present invention overcomes the problems described above, and provides a greatly improved slotter blade apparatus having a blade-shifting mechanism allowing the operator to "skip" cutting during one or more successive slotter wheel revolutions. In this fashion, blanks of any virtually required size may be readily accommodated without the need for employing ever larger diameter slotter wheels.

In particular, the present invention pertains to retractable blade slotter wheel devices of the type described in U.S. Pat. No. 5,297,462, which is incorporated by reference herein. The '462 patent represents a significant breakthrough in the art and discloses a slotter wheel mechanism wherein the slotting blade(s) thereof may be easily moved between an extended slotting position and a retracted blank-clearing position, during normal rotation of the slotter wheel. The present invention provides improved devices of this character which include activation/deactivation structure allowing alternate high speed fixed blade operation or selectively movable blade operation.

In one aspect of the present invention, a rotatable wheel or body having an axial length (i.e., thickness) and a peripheral margin is provided, along with at least one slotter blade having an elongated cutting edge oriented substantially perpendicular to the axial length of the body; stated otherwise, the slotter blade presents an arcuate elongated cutting edge in which tangents to the edge are oriented substantially perpendicular to the axial length of the body. Means operably couples the blade(s) with the body and includes structure for selective shifting of the blade during body rotation between an extended slotting position and a retracted, blank-clearing position; the blade shifting structure includes a first component rotatable with the blade and a second component adjacent the first component, with the first and second components being interengageable for permitting selective shifting of the blade. Also, an activation/deactivation assembly is provided for selectively separating the first and second components to allow rotation of the blade and first component without interengagement between the first and second components, and for alternately causing such interengagement in order to permit the desired selective blade shifting. In this fashion, the slotter wheel apparatus may be alternately operated as a normal, high speed slotter without any interference or slowdown because of interengagement between the blade-shifting components, or as a shiftable blade device for specially configured blanks.

In preferred forms, the first component is in the form of a follower rotatable with the cutting blade(s) and the second component is in the form of a cam track. The cam track advantageously includes a stationary cam track section and an adjacent, mating shiftable cam track section. The blade shifting assembly of the invention includes means for selectively moving the shiftable cam track section between respective positions for either extending or retracting the cutting blade(s) during rotation thereof.

Alternate separation and interengagement of the first and second components is effected by means of short-stroke piston and cylinder assemblies operably coupled with the cam track assembly. These piston and cylinder assemblies can be selectively actuated to move the cam track between separated and engaged positions relative to the mating follower.

In another aspect of the invention, a retractable blade slotting wheel apparatus is provided with blade-shifting structure including a shock absorbing assembly for absorbing mechanical shocks incident to shifting of the blade(s) from retracted to extended positions. This shock absorbing assembly comprises a operating member shiftable with the blade, and resilient bumper structure oriented for engagement with the operating member upon blade shifting from the retracted to extended positions. Use of such a shock absorbing assembly assures smoother, quieter and longer-lived operation of the slotter wheel apparatus.

DETAILED DESCRIPTION OF THE PREFERRED EMBODIMENTS

Figure 1:
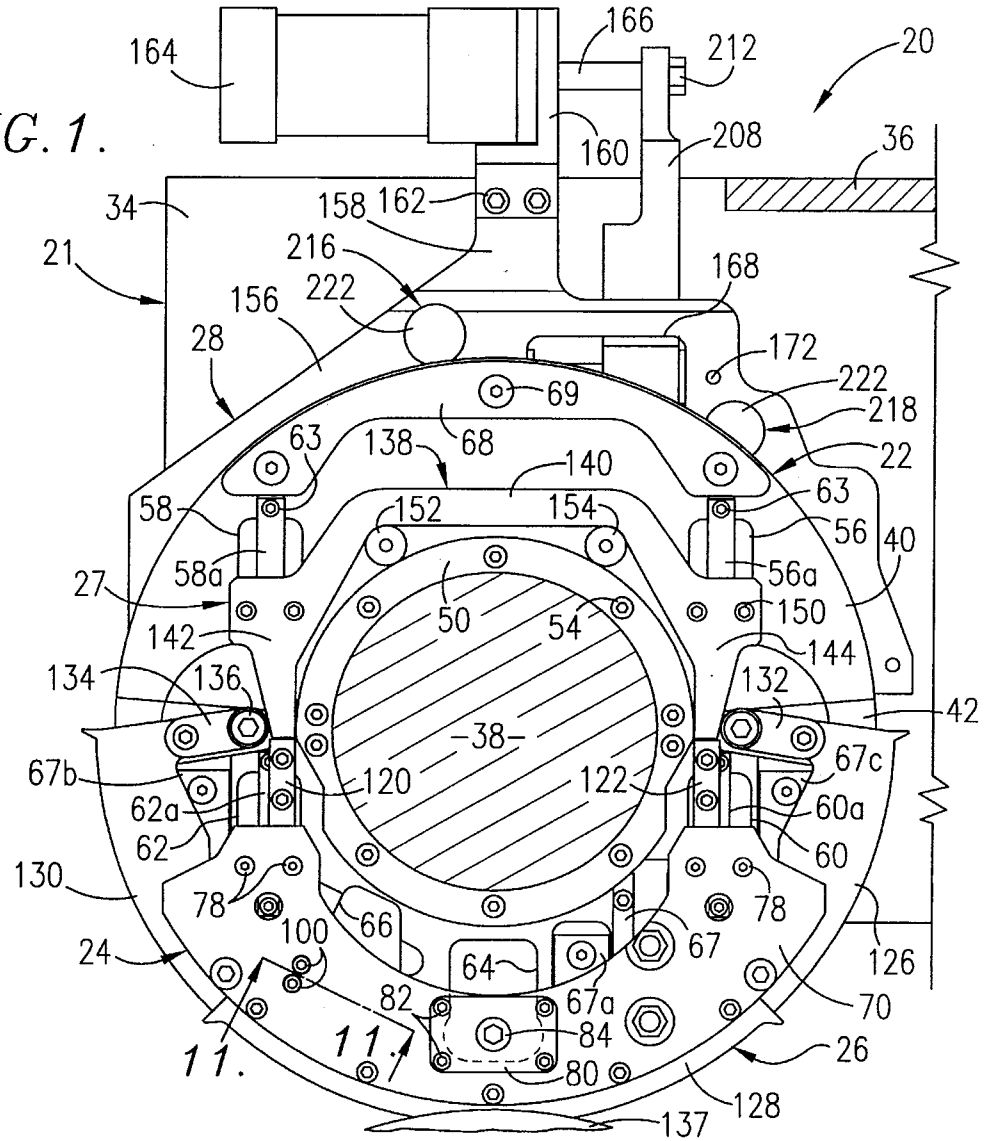
FIG. 1 is a side view of the preferred slotter wheel apparatus of the invention, shown with the front yoke plate removed and with a segmented cutting blade in its extended, blank-slotting position.

Turning now to the drawings, and particularly FIGS. 1–6, a slotter wheel apparatus 20 is illustrated. Broadly speaking, the apparatus 20 includes an outboard yoke assembly 21, primary rotatable wheel 22 (FIG. 3), a shiftable cutting blade holder 24 supporting a segmented cutting blade 26, a shock absorbing assembly 27, a cam track assembly 28 (FIG. 4) and an activation/deactivation assembly 30.

In more detail, the yoke assembly 21 includes a pair of downwardly extending, somewhat U-shaped yoke plates 32, 34 interconnected by an upper crosspiece 36. The lower bifurcated ends of the yoke plates are astride central drive shaft 38, and are supported by upper guide rods (not shown) parallel with shaft 38. In addition, motive means is provided for the lateral shifting of the assembly 21, and thus the entirety of the slotter wheel apparatus 20, along the length of shaft 38. In this fashion, the apparatus 20 can be laterally positioned at any desired location for box blank forming operations.

Figure 10:
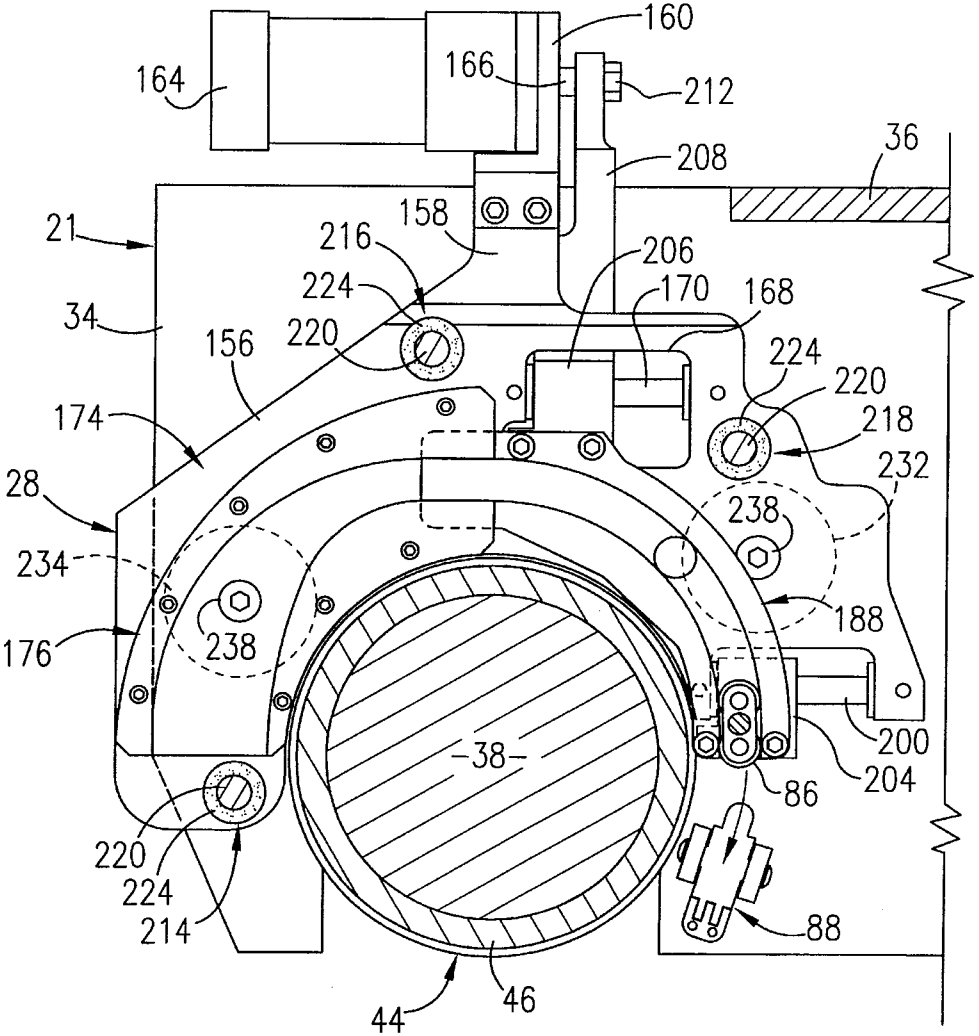
FIG. 10 is a side view similar to that of FIG. 4, but illustrating the shiftable cam track position in its orientation corresponding to the retracted position of the cutting blade.
Figure 8:
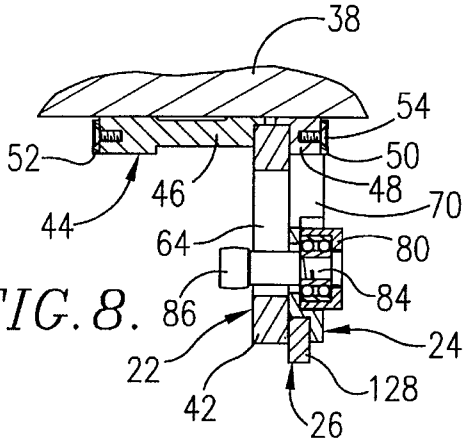
FIG. 8 is an enlarged, fragmentary sectional view illustrating the wheel and follower component carried thereby.

Primary wheel 22 is in the form of an annular body made up of two interconnected wheel segments 40, 42. Referring to FIG. 10, it will be seen that the wheel 22 is positioned on shaft 38 by means of a two-piece hub 44 (FIG. 8). The hub 44 has a first annular segment 46 and a second annular segment 48. The segments 46, 48 are axially shiftable on shaft 38 via key and keyway structure (not shown) and serve to sandwich the inner margin of wheel segments 40, 42 in place. Additionally, each of the hub segments is provided with an outer wear ring 50, 52 secured to the associated segment by screws 54. Returning to FIG. 3, it will be seen that wheel segment 40 is provided with a pair of generally rectangular openings 56, 58 therein. Similarly, the segment 42 also has two rectangular openings 60, 62 therein. An elongated guide pin 56*a*, 58*a*, 60*a* and 62*a* extend lengthwise across the corresponding openings 56–62 and are secured to the wheel by screws 63. In addition, the segment 42 has a somewhat wider but still generally rectangular opening 64 therein, as well as an irregular opening 66. The purpose of the openings 56–66 will be made clear hereinafter. Finally, segment 42 of wheel 22 supports a pair of laterally spaced apart, elongated track guides 67, as well as three wear pads 67*a*, 67*b* and 67*c*.

Figure 3:
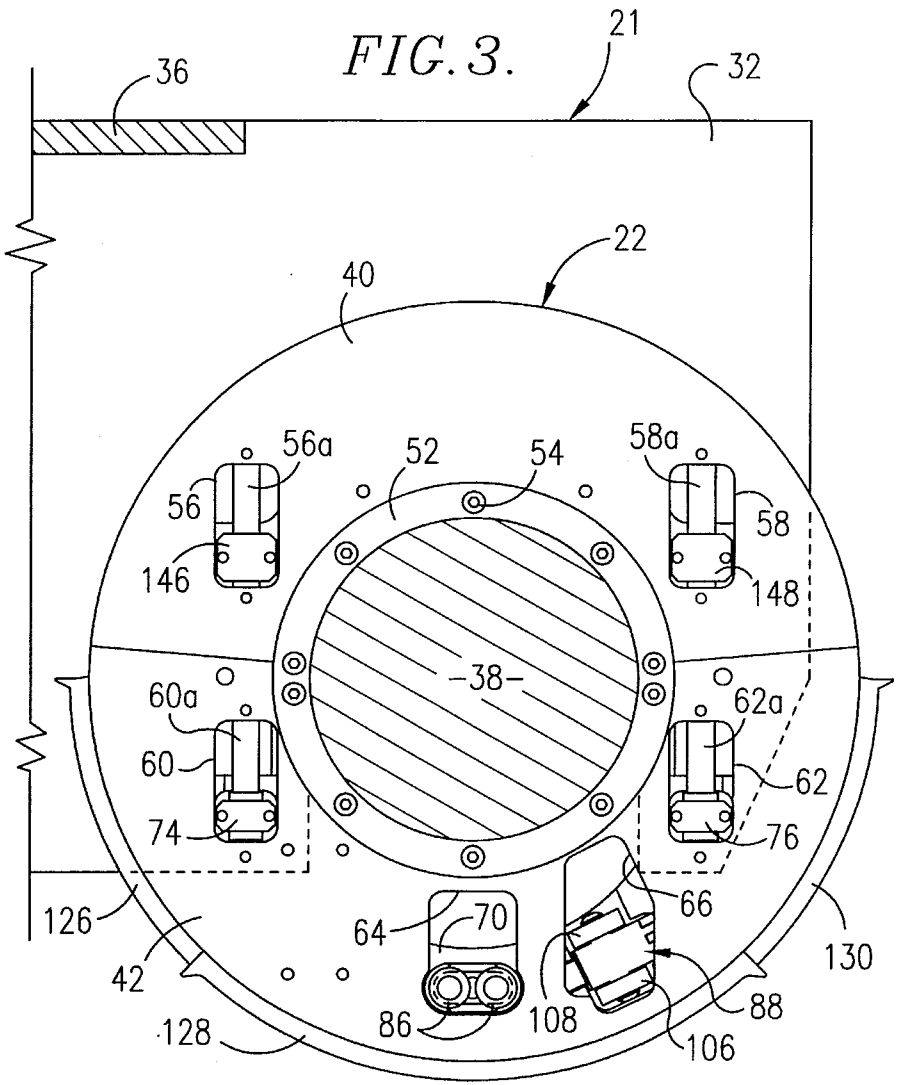
FIG. 3 is a side view of the primary wheel body forming a part of the slotter wheel apparatus of the invention.

FIG. 1 illustrates the opposite face of wheel 22 as compared with that depicted in FIG. 3. It will be observed that an arcuate counterweight 68 is affixed to this face of wheel segment 40 by means of screws 69. In addition, cutting blade holder 24 is supported on segment 42 and the shock absorbing assembly 27 is supported on segment 40.

Figure 2:
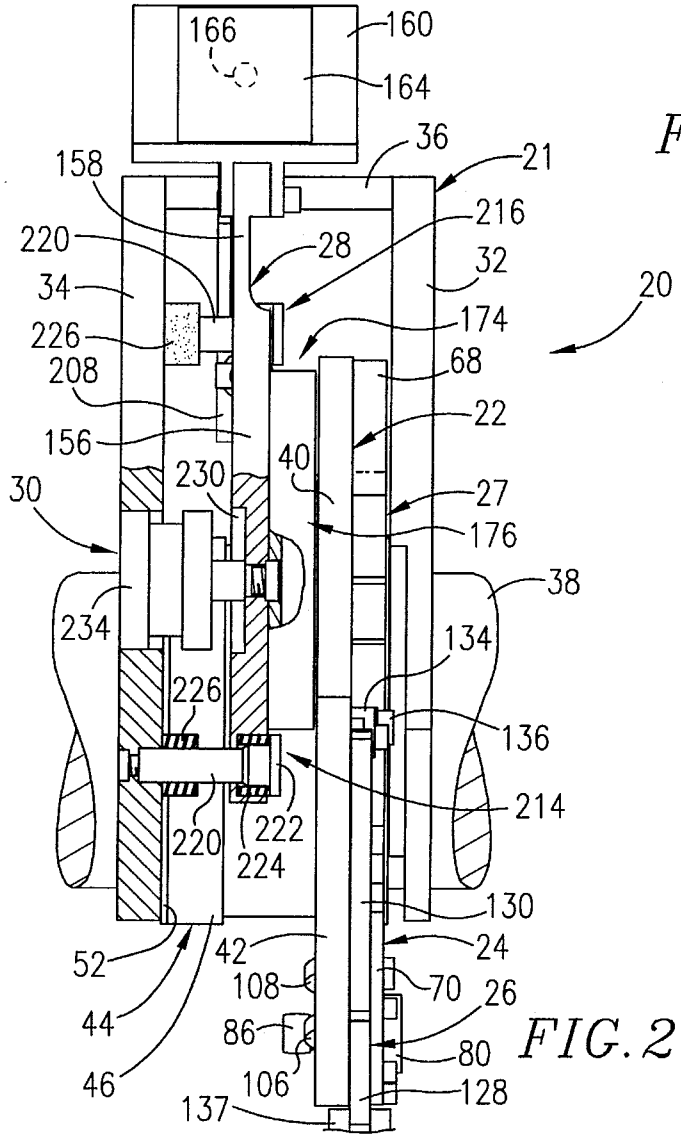
FIG. 2 is an end view of the apparatus depicted in FIG. 1, with certain parts shown in section to illustrate the construction thereof, and depicting the follower and cam track components in their engaged orientation.

Cutting blade holder 24 is shiftably secured to wheel 22 and particularly segment 42 thereof. It will be observed that the holder 24 is in the form of an arcuate body 70 which supports two slide bearings 74, 76 within the openings 60, 62 and in orientation for receiving the guide pins 60*a*, 62*a*. The bearings 74, 76 are affixed to blade holder body 70 by means of screws 78. The blade holder body 70 also supports, at the central region thereof, a follower support 80 located adjacent wheel opening 64. The follower support is secured to body 70 by means of screws 82, and includes a projecting pin 84 which terminates in a dual roller follower 86. As best seen in FIG. 2, the follower 86 is positioned adjacent the face of wheel 22 remote from blade holder 24 and cutting blade 26.

Figure 11:
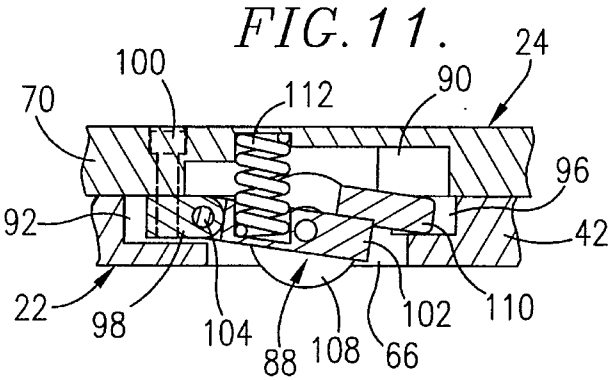
FIG. 11 is an enlarged, fragmentary sectional view illustrating in detail the spring-loaded locking mechanism provided for locking the blade holder in position on the main wheel.

The body 70 also supports a locking mechanism broadly referred to by the numeral 88 adjacent opening 66. Referring specifically to FIGS. 2, 3, 9 and 11, it will be seen that blade holder 24 includes a recess 90, whereas segment 42 of wheel 22 likewise has a proximal recess 92 as well as a pair of spaced, arcuate locking recesses 94, 96. The locking mechanism 88 includes a main body 98 secured to blade holder body 70 by screws 100. The mechanism 88 further has an operating segment 102 pivotally secured to body 98 via pin 104. The operating segment carries a pair of rotatable locking wheels 106, 108, as well as a projecting locking tab 110 designed to fit within one of the corresponding recesses 94, 96. As best seen in FIG. 11, a coil spring 112 is provided between body 70 and operating segment 102 in order to bias the latter into a locking position relative to wheel 22.

Figure 9:
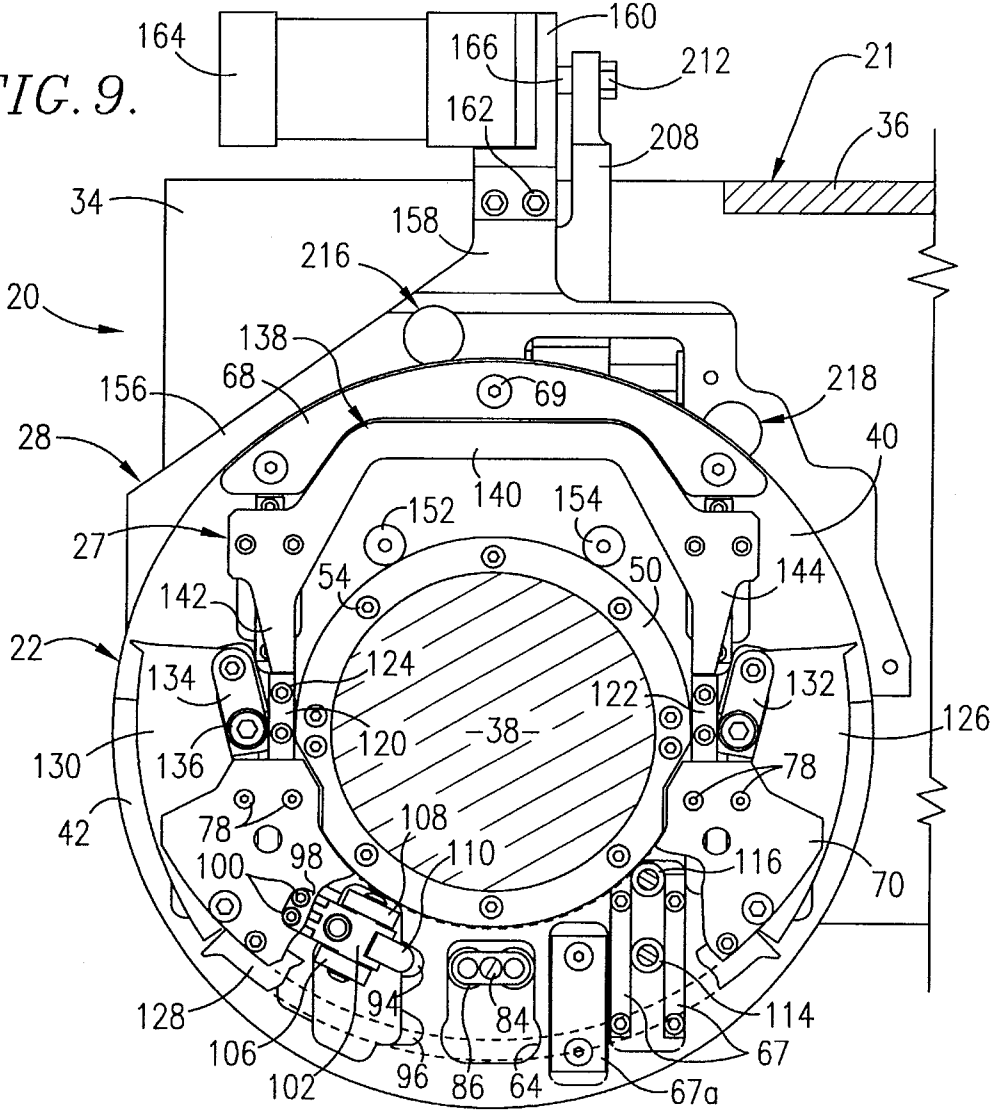
FIG. 9 is a view similar to that of FIG. 1 but with parts broken away and illustrating the segmented cutting blade in its retracted, blank-clearing position.

The body 70 also supports a pair of guide rollers 114, 116 which are secured by fasteners 118. As best seen in FIG. 9, the rollers 114, 116 are located between the track guides 67. These guide rollers serve to assist in the inward and outward reciprocation of blade holder 24 and cutting blade 26 as will be described in detail hereinafter.

The opposed ends of blade holder 24 include respective extensions 120, 122 which interconnect with the corresponding ends of shock absorbing assembly 27. Screws 124 are employed for interconnecting the extensions 120, 122 with the shock absorbing assembly.

Cutting blade 26 in the form illustrated includes a total of three pivotally interconnected blade segments 126, 128, 130. The ends of segments 126 and 130 are connected to pivotal links 132, 134, with the latter being pivotally secured by connectors 136 to wheel segment 42. It will be appreciated that while a segmented blade 26 is illustrated, the invention is not so limited; i.e., unitary blades, usually of shorter length, can also be employed. As those skilled in the art will recognize, blade 26 in its extended position is received within a rotatable anvil 137 (FIG. 1). The anvil 137 includes a blade-receiving slot in the periphery thereof which receives the outer periphery of blade 26 to assist in slotting operations.

The shock absorbing assembly 27 includes a bridge piece 138 presenting a central bight section 140 as well as a pair of angularly oriented legs 142, 144. Each of the latter includes a slide bearing 146, 148 which is affixed by fasteners 150. As best seen in FIGS. 1 and 3, the slide bearings 146, 148 receive corresponding guide pins **56*a* and 58*a*. The extreme ends of the legs 142, 144 are, as described previously, coupled to the blade holder extensions 120, 122. The overall assembly 27 further comprises a pair of resilient annular bumpers or shock absorbers 152, 154 which are secured to segment 40 of wheel 22 in a location to abut the inner corners of bridge piece 138 when the latter is in its FIG. 1** position.

Figure 4:
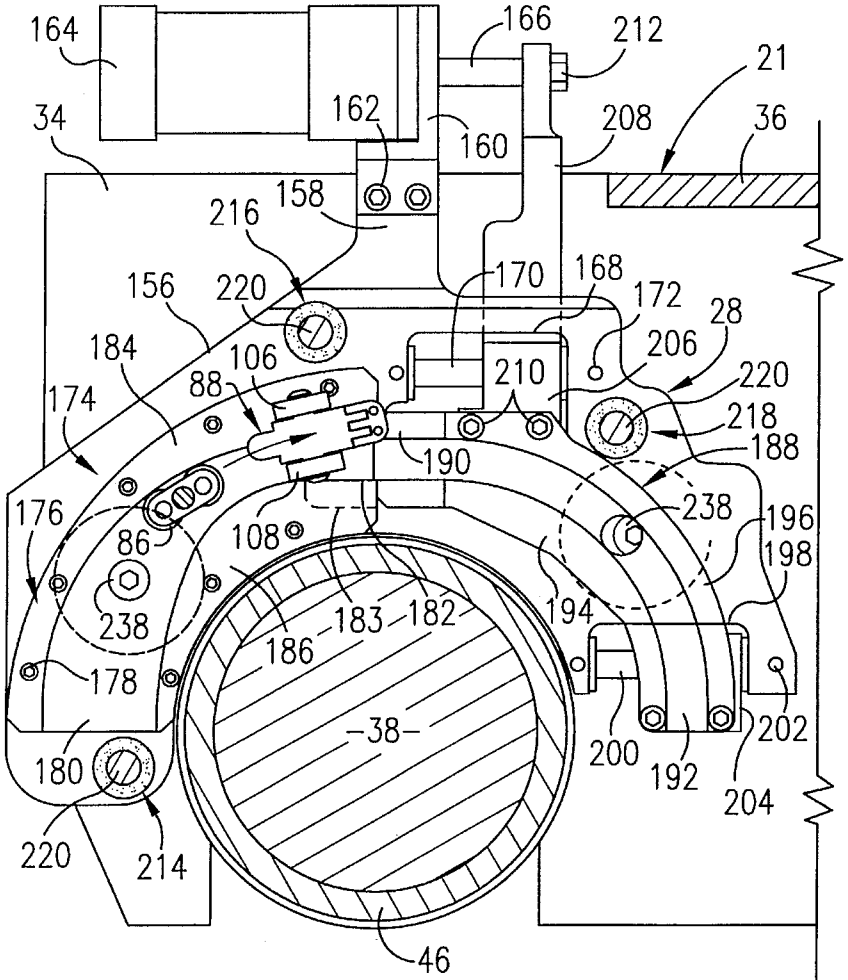
FIG. 4 is a side view depicting the cam track assembly forming a part of the slotter wheel apparatus, wherein the cam track is in its orientation corresponding to the extended position of the cutting blade.

The cam track assembly 28 is best illustrated in FIGS. 4 and 10. The assembly 28 includes a non-rotating stationary, somewhat U-shaped main plate 156 situated between wheel 22 and yoke plate 34. The plate 156 has an upstanding leg 158 which supports a bifurcated bracket 160 coupled thereto via screws 162. The bracket 160 in turn carries a conventional piston and cylinder assembly 164, the latter including an extensible and retractable piston rod 166.

Figure 6:
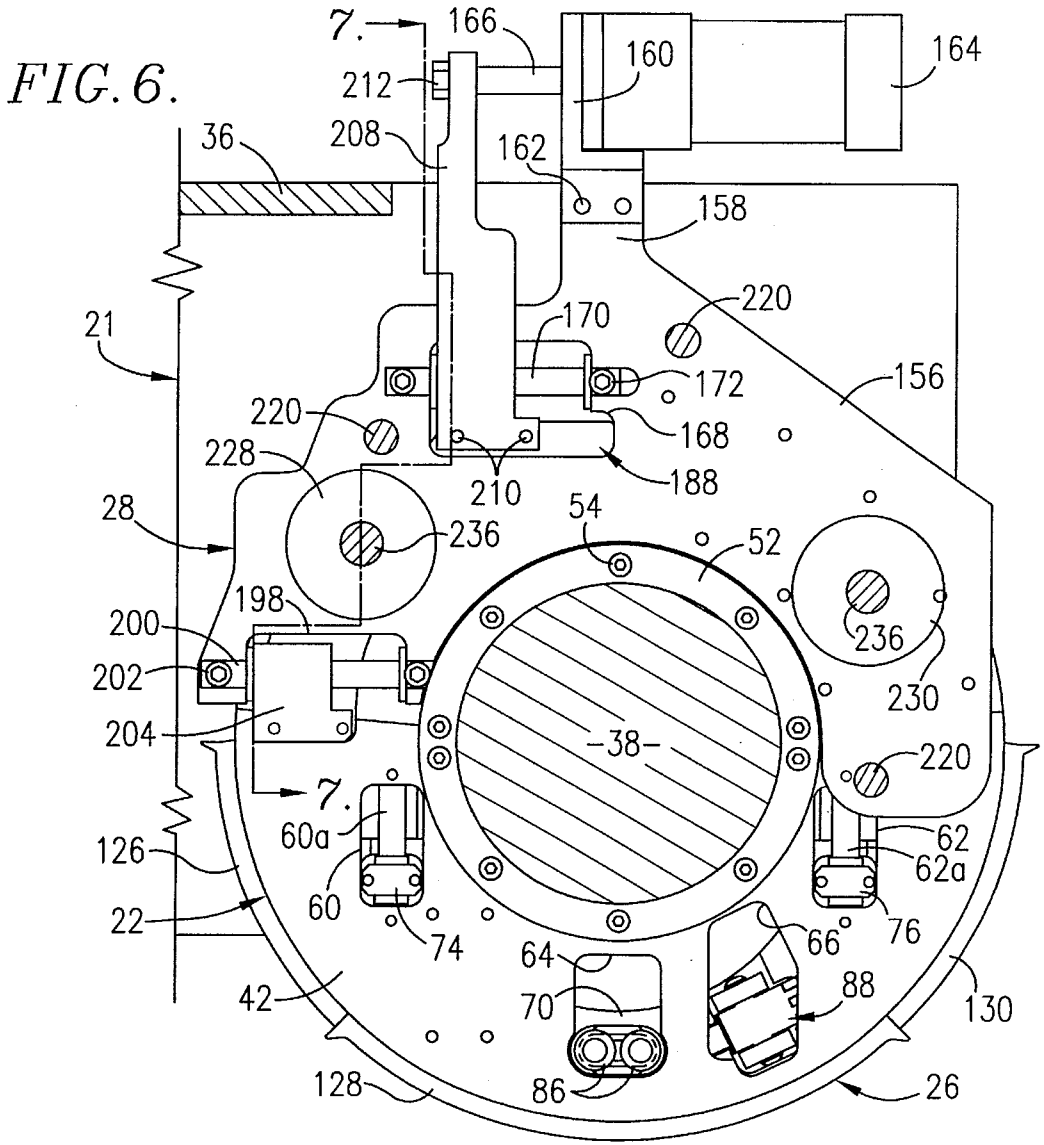
FIG. 6 is a side view depicting the cam track-supporting plate and the adjacent rotatable wheel forming a part of the slotter wheel apparatus.
Figure 7:
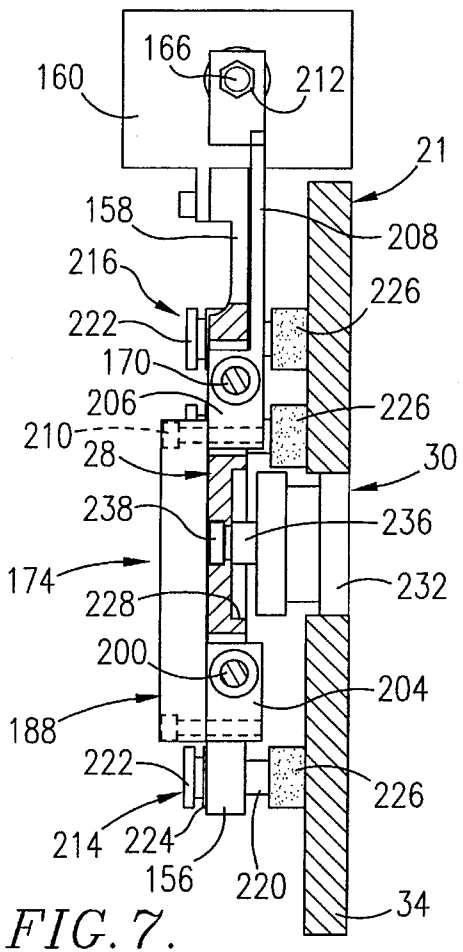
FIG. 7 is a vertical sectional view taken along line 7—7 of FIG. 6.

The plate 156 has a generally rectangular opening 168 therein with an elongated guide pin 170 extending along the length thereof and secured to plate 156 by screws 172 (see FIG. 6).

A two-part cam track 174 is affixed to the face of main plate 156 adjacent wheel 22. The cam track includes a stationary cam track section 176 affixed to the plate via screws 178 and presenting a relatively wide inlet mouth 180 and a somewhat narrower exit end 182; the exit end is provided with a tongue-receiving recess 183. The opposed, defining walls of the arcuate cam track present relatively wide bearing surfaces 184, 186 which is important for purposes to be described. The overall cam track 174 also includes a shiftable cam track section 188. In this case, the section 188 includes an inlet end 190 in the form of a tongue adapted to be received within recess 183 in one position of the shiftable track section. The exit end 192 of shiftable section 188 is located approximately 180° from mouth 180 as shown. The opposed, defining sidewalls of the cam track likewise present surfaces 194, 196.

The end of plate 156 adjacent exit end 192 of the cam track 174 includes a generally rectangular recess 198. A transversely extending guide pin 200 is supported by screws 202 and extends across the recess as shown. The shiftable cam track section 188 is supported for inward and outward movement by means of bearing blocks 204, 206. The block 204 is secured to the face of cam track section 188 remote from the surfaces 194, 196, and receives guide pin 200. Block 206 on the other hand receives guide pin 170 and has an upstanding operating arm 208 secured thereto. As best seen in FIG. 4, the lower end of arm 208 is attached by screws 210 to shiftable track section 188, whereas the upper end of arm 208 is connected to piston rod 166 by nut 212.

The plate 156 supporting cam track 174 is also equipped with three shock absorbing assemblies 214, 216, 218. Each of the latter includes a guide pin 220 having an enlarged head 222 adjacent the face of plate 156 supporting cam track 174. The opposite end of each pin 220 is threaded into stationary yoke plate 34 (see FIG. 2) A first annular shock absorbing pad 224 is embedded within an appropriate recess in plate 156 beneath each head 222. In addition, a second annular shock absorbing pad 226 is positioned about each pin 220 and abuts the face of yoke plate 34 adjacent plate 156.

Referring specifically to FIGS. 2 and 6, it will be seen that plate 156 has a pair of annular recesses 228, 230 formed therein in the face of the plate remote from cam track 174. These recesses cooperate with components of the activation/deactivation assembly 30.

The assembly 30 includes a pair of short stroke piston and cylinder assemblies 232, 234 which are each received within appropriate openings in yoke plate 34. Each of the assemblies 232, 234 includes a rod 236 which is affixed to plate 156 via screws 238. Operation of the assemblies 232, 234 thus serves to laterally shift the main cam track plate 156 toward and away from wheel 22.

OPERATION

The slotter wheel apparatus 20 of the invention can be operated in an entirely conventional fashion, i.e., without intermittent extension or retraction of slotter blade 26. In this mode of operation, the apparatus 20 can be used as a normal, high speed slotting device. Alternately, the apparatus 20 can be operated to selectively extend or retract blade 26 during rotation thereof for creation of blanks of virtually any desired size and slot configuration. This dual capability renders the apparatus 20 uniquely able to meet the demands of a modern-day box blank-making factory.

Figure 5:
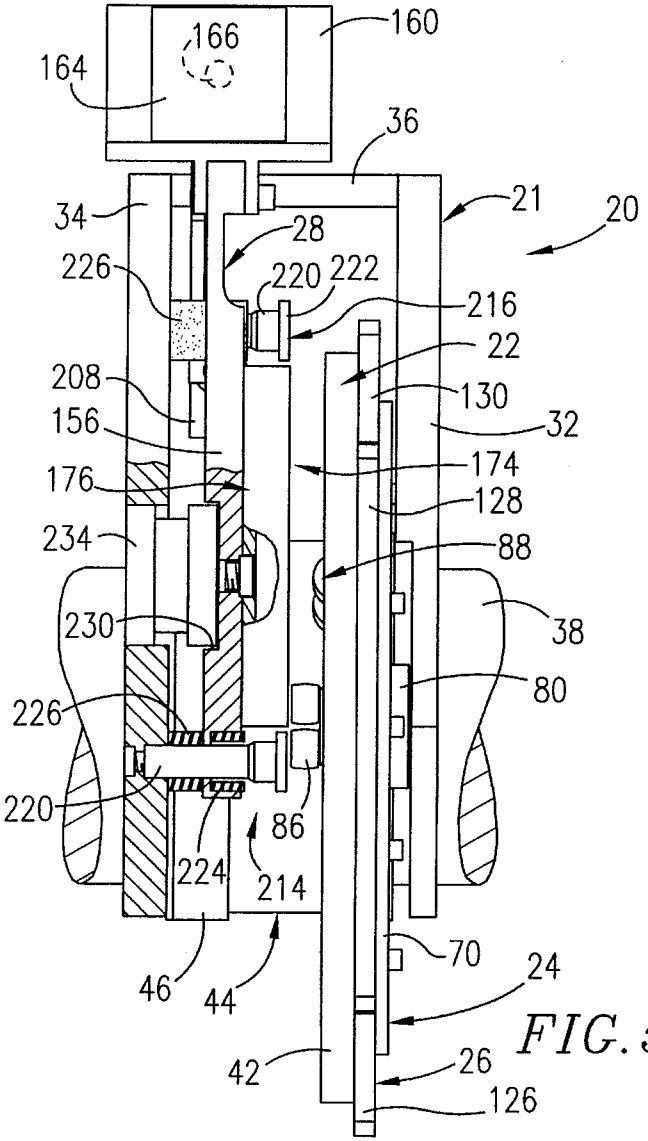
FIG. 5 is a view similar to that of FIG. 2 but illustrating the follower and cam track components in their separated relationship not permitting selective blade shifting.

In particular, attention is directed to alternate FIGS. 2 and 5. In FIG. 2, the apparatus 20 is shown in its activated mode wherein the slotter blade 26 may be selectively extended or retracted as desired. On the other hand, FIG. 5 depicts the orientation of the apparatus wherein the blade 26 is deactivated and constantly maintained in its extended slotting position.

Referring specifically to FIG. 2, it will be seen that the short stroke piston and cylinder assemblies 232, 234 have been extended so that follower 86 is oriented for receipt in cam track 174 during rotation of shaft 38 (and thus wheel 22, blade 26 and blade holder 24). Also in this configuration, the piston and cylinder assembly 164 is in its fully extended position as shown in FIG. 1, i.e., the shiftable cam track section 188 is moved rightwardly as viewed in FIG. 4.

As the wheel 22 and blade 26 rotate, the follower 86 successively enters the mouth 180 and traverses the entire cam track defined by the cooperating sections 176 and 188. This action is best shown in FIG. 4. The locking mechanism wheels 106, 108 also ride upon the surfaces 184, 186 and 194, 196 during its passage along track 174, so as to pivot spring-biased operating segment 102 and tab 110 out of locking engagement with wheel 22. This condition is maintained until the wheels 106, 108 leave the exit end 192 of stationary cam track section 188, whereupon the locking mechanism 88, under the influence of spring 112, is shifted to its FIG. 11 position with tab 110 within the recess 96 serving to lock the wheel 22 and cutting blade holder 24 together. In any case, it will be seen that during continued rotation of apparatus 20 in this mode of operation, the blade 26 is in its extended, slotting position.

When the assembly 30 is in its activated orientation (see FIG. 2), the blade 26 can be selectively retracted to its blank-clearing position and then extended in any desired sequence, e.g., two rotations of apparatus 20 can be made with the blade retracted, and a single rotation made with the blade extended. In order to effect such selective blade extension (while the activation/deactivation assembly 30 is in the FIG. 2 position), it is only necessary to activate piston and cylinder assembly 164 to withdraw piston rod 166 and thus move shiftable cam track section 188 leftwardly as viewed in FIG. 10. When this occurs, the cam track is configured for retracting the blade 26 during the next revolution when locking mechanism 88 enters cam track 174 to unlock blade holder 24 from wheel 22, and follower 86 enters and traverses the cam track. During passage of the follower 86 through the cam track, the blade holder 24 (and thus blade 26) is retracted inwardly to assume the blank-clearing position of FIG. 9. As will be evident from a study of comparative FIGS. 1 and 9, the links 132 pivot from a generally horizontal position as viewed in FIG. 1 to a generally vertical position as viewed in FIG. 9; this allows shifting of the blade holder and blade to the FIG. 9 position. When the blade 26 is fully retracted, locking mechanism passes exit end 192 of track 174, whereupon spring 102 urges tab 110 into recess 94 to lock the blade in the retracted position. The blade will thus stay retracted until assembly 164 is again activated.

It will of course be evident that such shifting movement of the blade holder 24 and blade 26 is guided by means of the pins 60*a*, 62*a* and the associated bearing blocks 74, 76. Such motion is further guided by the guide rollers 114, 116 moving along the path defined by the spaced track guides 67.

When it is desired to extend the blade 26 from the FIG. 9 retracted position to the extended FIG. 1 position, the above-described sequence is reversed. That is to say, at an appropriate time during rotation of apparatus 20, piston and cylinder assembly 164 is activated so as to extend piston rod 166. This causes the shiftable cam track section 188 to move rightwardly as viewed in FIG. 10 so that the cam track 174 again assumes the position for maintaining the blade 26 in its extended orientation. After such shifting of the track section 188, the locking mechanism 88 during its continued rotation encounters the cam track 174, as does follower 86. When this happens, the locking mechanism operates as described above to free blade holder 24 from wheel 22, and the movement of follower 86 within the cam track extends the blade holder 24 through the pivotal links 132. Again, such outward movement of the blade holder is guided by the pin and bearing block assemblies 60*a*, 74 and 62*a*, 76, as well as through the medium of rollers 114, 116 and track guides 67.

Additionally, during the outward shifting of blade 26 to its slotting position, the shock absorbing assembly 27 comes into play. Specifically, as blade holder 25 and blade 26 reach the outer limit of their shifting under the influence of the cam track and follower structure, the bridge piece 138 contacts the pads 152, 154 so as to absorb the mechanical shocks incident to such shifting. It will also be apparent that inward and outward movement of the bridge piece 138 is guided by the pins 56*a*, 58*a* and the associated bearing blocks 146, 148.

When the user desires to employ apparatus 20 as a conventional slotting wheel, i.e., with the blade constantly maintained extended and at high rotational speeds, the activation/deactivation assembly 30 is operated. Specifically, the short-stroke piston and cylinder assemblies 232, 234 are used to retract cam plate 156 leftwardly as viewed in FIG. 5 until follower 86 is positioned in spaced relationship from the cam track 174. As a consequence, the wheel 22, blade holder 24 and blade 26 can then operate independently without any contact or engagement with the cam track 174. This allows the desirable high speed slotting operation to continue without any slowdowns or interferences from the blade shifting structure.

Again referring to FIG. 5, it will be observed that the shock absorbing assemblies 214–218 operate during use of the activation/deactivation assembly 30 to absorb shocks and cushion the movement of the plate 154 into and out of engagement with the follower 86. Thus, the pads 226 come into engagement with the face of plate 154 remote from cam track 174 when the latter is moved from its engaged to disengaged position. During opposite movement of the plate, the embedded pads 224 serve a similar function by virtue of abutment between these pads and the heads 222.

We claim:

1. Slotter wheel apparatus for slotting box blanks at selectively variable locations along the length of the blanks as the blanks are sequentially advanced along a path of travel, said apparatus comprising:

a rotatable body presenting an axial length and a peripheral margin;

at least one slotter blade having an arcuate elongated cutting edge in which tangents to the edge are oriented substantially perpendicular to said axial length;

means operably coupling said blade with said body for rotation therewith and including structure for selective shifting of said blade during rotation of said body between an extended slotting position wherein the blade cutting edge is oriented for slotting of said blank, and a retracted, blank-clearing position wherein the blade cutting edge will pass said blank without slotting thereof, said blade-shifting structure including a first component rotatable with said blade and a second component adjacent said first component, said first and second components being interengageable for permitting said selective shifting of said blade; and means for selectively separating said first and second components for allowing rotation of said blade and first component without interengagement between the first and second components, and for alternately causing interengagement between the first and second components in order to permit said selective blade shifting.

2. The apparatus of claim 1, said first component comprising a follower rotatable with said blade, said second component comprising a cam track.

3. The apparatus of claim 2, said cam track including a stationary cam track section and a shiftable cam track section, said blade-shifting structure further including means for selectively shifting said shiftable cam track section between respective positions corresponding to said extended and retracted blade positions.

4. The apparatus of claim 3, said cam track section shifting means including a first piston and cylinder assembly operably coupled with said shiftable cam track section.

5. The apparatus of claim 1, said separating means comprising motive means operably coupled with one of said first and second components for selective movement of the one component into and out of interengagement with the other component.

6. The apparatus of claim 5, said motive means comprising a second piston and cylinder assembly having a shiftable element, said element being coupled with said second component.

7. The apparatus of claim 1, including resilient bumper means for absorbing mechanical shocks incident to said selective separation of said first and second components.

8. The apparatus of claim 1, including means for locking said blade in said extended and retracted positions thereof.

9. The apparatus of claim 1, including anvil means adjacent said body to define a region therebetween for receiving the box blanks as the latter are advanced along said path of travel.

10. The apparatus of claim 9, said anvil means being configured for reception of said slotter blade when the slotter blade is in said extended position thereof.

11. The apparatus of claim 1, said coupling means including a blade holder, means releasably securing said blade to said blade holder, and means shiftably coupling said blade holder to said body.

12. Slotter wheel apparatus for slotting box blanks at selectively variable locations along the length of the blanks as the blanks are sequentially advanced along a path of travel, said apparatus comprising:

a rotatable body presenting an axial length and a peripheral margin;

at least one elongated slotter blade having spaced end margins and an arcuate elongated cutting edge in which tangents to the edge are oriented substantially perpendicular to said axial length of said body;

means operably coupling said blade with said body for rotation therewith and including structure for selective shifting of said blade during rotation of said body between an extended slotting position wherein the blade cutting edge is oriented for slotting of said blank, and a retracted, blank-clearing position wherein the blade cutting edge will pass said blank without slotting thereof, said blade-shifting structure including a shock absorbing assembly for absorbing mechanical shocks incident to shifting of said blade from said retracted position to said extended position, said shock absorbing assembly comprising an operating member shiftable with said blade and resilient bumper structure oriented for engagement with said operating member upon shifting of said blade from said retracted position to said extended position.

13. The apparatus of claim 12, said operating member comprising a continuous bridge element shiftable with said blade between and inner position corresponding to the extended position of said blade and an outer position corresponding to said retracted position of said blade, said bumper structure being oriented for engagement by the operating member when the operating member moves to said inner position thereof.

14. The apparatus of claim 13, said bumper structure comprising a pair of spaced apart resilient synthetic resin bumper pads secured to said body.

15. The apparatus of claim 12, including blade shifting structure comprising a first component rotatable with said blade and a second component adjacent said first component, said first and second components being interengageable for permitting said selective shifting of said blade, there being means for selectively separating first and second components for allowing rotation of said blade and first component without interengagement between the first and second components, and for alternately causing interengagement between the first and second components in order to permit said selective blade shifting.

16. The apparatus of claim 15, said first component comprising a follower rotatable with said blade, said second component comprising a cam track.

17. The apparatus of claim 15, said cam track including a stationary cam track section and a shiftable cam track section, said blade-shifting structure further including means for selectively shifting said shiftable cam track section between respective positions corresponding to said extended and retracted blade positions.

18. The apparatus of claim 17, said cam track section shifting means including a first piston and cylinder assembly operably coupled with said shiftable cam track section.

19. The apparatus of claim 12, said separating means comprising motive means operably coupled with one of said first and second components for selective movement of the one component into and out of interengagement with the other component.

20. The apparatus of claim 19, said motive means comprising a second piston and cylinder assembly having a shiftable element, said element being coupled with said second component.

21. The apparatus of claim 12, including resilient bumper means for absorbing mechanical shocks incident to said selective separation of said first and second components.

22. The apparatus of claim 12, including means for locking said blade in said extended and retracted positions thereof.

23. The apparatus of claim 12, including anvil means adjacent said body to define a region therebetween for receiving the box blanks as the latter are advanced along said path of travel.

24. The apparatus of claim 23, said anvil means being configured for reception of said slotter blade when the slotter blade is in said extended position thereof.

25. The apparatus of claim 12, said coupling means including a blade holder, means releasably securing said blade to said blade holder, and means shiftably coupling said blade holder to said body.

* * * * *

UNITED STATES PATENT AND TRADEMARK OFFICE

CERTIFICATE OF CORRECTION

PATENT NO. : 5,540,128

DATED : July 30, 1996

INVENTOR(S) : David E. Creaden

It is certified that error appears in the above-indentified patent and that said Letters Patent is hereby corrected as shown below:

Title page, item [54] and col. 1, line 1, delete "SLUTTER" and substitute --SLOTTER--.

Signed and Sealed this

Seventeenth Day of December, 1996

*Attest:*

*Attesting Officer*

BRUCE LEHMAN

*Commissioner of Patents and Trademarks*